United States Patent [19]

Deforeit

[11] 4,279,186

[45] Jul. 21, 1981

[54] POLYPHONIC SYNTHESIZER OF PERIODIC SIGNALS USING DIGITAL TECHNIQUES

[76] Inventor: Christian J. Deforeit, 202 rue des Joncs-Marins, 91620 La Ville du Bois, France

[21] Appl. No.: 92,468

[22] Filed: Nov. 8, 1979

[30] Foreign Application Priority Data

Nov. 21, 1978 [FR] France ..... 78 32727
Mar. 23, 1979 [FR] France ..... 79 07339

[51] Int. Cl.[3] ..... G10H 1/00; G10H 3/03

[52] U.S. Cl. ..... 84/1.01; 84/1.19; 84/1.28

[58] Field of Search ..... 84/1.01, 1.19, 1.11, 84/1.28

[56] References Cited

U.S. PATENT DOCUMENTS

| | | | |
|---|---|---|---|
| 3,955,459 | 5/1976 | Mochida et al. | 84/1.01 |
| 3,982,460 | 9/1976 | Obayashi et al. | 84/1.01 |
| 4,023,454 | 5/1977 | Obayashi et al. | 84/1.01 |
| 4,149,440 | 4/1979 | Deforeit | 84/1.01 |
| 4,177,706 | 12/1979 | Greenberger | 84/1.01 |
| 4,193,332 | 3/1980 | Richardson | 84/1.01 |

*Primary Examiner*—J. V. Truhe
*Assistant Examiner*—Forester W. Isen

[57] ABSTRACT

The invention concerns a polyphonic musical synthesizer using digital techniques. The generation of successive wave form patterns makes use of phase data for addressing a wave form memory, and of amplitude and harmonic or octave row data contained in a set of memory blocks. Control of the synthesizer is effected by externally addressing the memory set in order to write the aforementioned data in it.

The development of synthesis operations within the synthesizer is conditioned by a sequential chain of reading of the different memory blocks in terms of signals from a plurality of generators.

15 Claims, 7 Drawing Figures

POLYPHONIC SYNTHESIZER OF PERIODIC SIGNALS USING DIGITAL TECHNIQUES

The present invention relates to a polyphonic synthesizer of periodic signals using digital techniques, and more generally to polyphonic, electronic musical instruments comprising one or more of these synthesizers.

A synthesizer of this type was described in French patent application No. 7720245 filed on July 1, 1977.

In this device each output signal results from a succession of digital patterns produced at least from a wave form pattern memory, read at variable frequency and then converted into analog form.

Contrary to other musical synthesis devices using digital techniques, in which wave form patterns are read in a single, fixed frequency pattern memory but at variable phase intervals (according to the final frequency to be obtained), the present invention concerns a synthesizer in which reading of the patterns takes place at variable frequencies from several pulse signals produced by generators built into the synthesizer.

Such a structure better lends itself to the construction of a synthesizer which is completely independent of the rest of the musical instrument and which may be easily controlled by a microprocessor.

The synthesizer behaves like an assembly of independent signal generators controlled from an assembly of memories each containing at least the amplitude of an outgoing signal. In reading each memory, the synthesizer carries out a digital-analog conversion to convert the amplitude data read and an instantaneous phase value into a positive or negative analog stage of voltage or current.

In the first aforementioned synthesizer, all of the periodic signals which it may produce are generated cyclically and permanently, even if the amplitudes of most of them are zero, since the control circuits of the synthesizer, activated by the incorporated pulse generators, order a digital-analog conversion for each datum in the memory assembly whatever its value. In order that a signal not be produced it is necessary to insert a datum equal to zero into the corresponding memory.

Most of the time, the number of signals produced by the synthesizer is small compared with the maximum number of signals which it can produce. This entails that, within the synthesizer, numerous logical conversion operations are carried out uselessly for signals which in the end are not produced, while in the control microcomputer write operations for the amplitude data equal to zero are necessary, leading to a double loss of time.

Accordingly one object of the present invention is to eliminate this disadvantage by doing away with the synthesis of nonrequired signals. Thus, in use, only the memories related to the signals to be produced are used.

Another object of the present invention is to profit from the time savings achieved by enabling synthesis of additional signals or by increasing the number of possible periodic signals.

The invention, as defined in the claims, solves the problem of limiting the work of the synthesizer to the production of only the signals required by organizing the data in the control memories so that these data are interconnected. The significant data alone are included in this chain. Reading of the data in the control memories, from pulse generators, and production of the corresponding patterns are thus carried out according to the given chain which is executed repetitively. The external means for use of the synthesizer may at any time change the interconnection of the data in the control memories and substitute a new interconnection for it. The means may also modify the data used in the synthesis without changing the chain.

To achieve this interconnection, each control memory must contain, in addition to the data used for the production of a pattern, an additional piece of information which is read by the synthesizer's control means and used by the latter to determine the next memory in the chain.

According to a first embodiment, the control memory assembly is divided into memory groups, equal in number to the number of pulse generators, with each group containing in addition a supplementary memory to contain a common submultiple of the instantaneous phase of several periodic signals, and each memory containing an area for receiving an address datum from another memory of the same group.

It appears therefore that the internal control means of the synthesizer are concerned solely with the control memories linked together in the chain, while the other control memories not forming part of the chain are ignored. The operations of the synthesizer are thus limited to production of only those periodic signals to be produced.

However, the fact that the control memory is cut into groups built into the machine limits the number of elementary tone components associated with each generator to the number of memories in a group minus one. As all of the groups are rarely all used together, a more or less large number of memories stays unused most of the time.

According to a second embodiment of the invention, the control memories of the synthesizer are no longer divided into groups and each memory may be attached to an generator. Each memory comprises an address datum from another memory for creation of the chain. In addition, there are two distinct types of memory: primary blocks essentially containing a submultiple of the instantaneous phase common to several signals and secondary blocks essentially containing the amplitude of these signals.

Of course, the data which may be registered in the control memories are not limited to those set forth above. This enables wide possibilities for control of the synthesizer by simple write operations in live memory.

The present invention brings about a considerable reduction in these write operations due to the interconnected chain. At the same time, the internal operations of the synthesizer are reduced.

Among the advantages of the present invention may be cited the possibility of reducing the frequency of the clock which synchronizes the circuits, leading to better possibilities for integration of these circuits in the form of integrated circuits.

The optimization of the operations of reading and conversion likewise enables an increase in the design flexibility of the synthesizer. Thus the size of the memory groups may be changed to increase or diminish the number of possible signals without increasing the complexity of use. Similarly, the number of generators and groups may vary, enabling the synthesis of new series of signals having frequencies which are not necessarily related to those of other generators. Thus the frequencies of these generators may be variable or uncertain.

Thanks to a second embodiment, the total processing time for the operations of the synthesizer is always kept to the minimum and memory use is optimal.

Reduction of processing time enables reduction in the time lag between the change of state of a generator and calculation of the patterns of the corresponding tonal components.

Elimination of group limits enables formation of elementary tones containing a large number of components.

In a general way, a digital music synthesizer is constructed around a wave form memory containing a digital representation, point by point, of a period (or of a portion of a period if symmetries exist) of a periodic wave form. The input for addressing the memory receives signals called "phase" and the output delivers the corresponding "amplitude" data or signals. The wave form memory thus performs the transcoding of a digital phase signal into a digital amplitude signal which is then converted into analog form.

To reconstitute a complete periodic analog signal, it is necessary to apply successive digital phase signals to the wave form memory. The latter then delivers successive amplitude signals which are applied to the digital-analog converter. These analog signals are filtered to eliminate quantization noise and the resultant analog wave form is restored.

Instead of a direct digital representation of the final wave form, the wave form memory may contain a differential representation of this wave form. Each numerical value represents the gap between the amplitude of the point being considered on the wave and that of the preceding point. The digital-analog converter is then followed by an integrator which restores the final wave form. This type of synthesis has the advantage of enabling the use of small scale digital information (eight bit words representing amplitude) without sacrificing the quality of the final result, the quality being equal to that of a direct synthesis using larger size information (16 bits).

There are two radically opposed methods for delivering periodic signals of different frequencies using the same wave form memory.

The first method consists of transmitting to the memory address signals of constant (and very high) frequency but in which the phase difference between two consecutive addressed values varies according to the final frequency to be produced. Although only one clock is required for all of these frequencies, this method necessitates complex circuits necessarily combined with the control circuits of the synthesizer (keyboard, pedals, set selection circuits, etc.).

The second method consists of transmitting to the pattern memory variable frequency address signals having frequencies directly proportional to the frequency to be produced, thus enabling the memory to be addressed with constant phase differences whatever the frequency.

A simple operation of incrementation suffices for all frequencies, which eliminates the need to calculate a phase gap for each frequency. On the other hand, the synthesizer must comprise several generators, which may be integrated, and a connection logic circuit for the generators and the control data.

The present invention concerns a synthesizer using the second method of synthesis (multiple frequencies), preferably in combination with a differential representation of the amplitude data.

It is also distinguished by the fact that the entirety of the commands destined for the synthesizer (frequencies, amplitudes, etc.) is reduced to simple write operations in memories called the "virtual keyboard."

The virtual keyboard thus constitutes a physical barrier between the synthesizer and the rest of the musical instrument. Such a synthesizer lends itself particularly well to connection with a microcomputer, in relation to which the synthesizer behaves like a simple peripheral device.

Within the synthesizer, all the components which make it up are thus placed into relation with the virtual keyboard.

In French patent application No. 7720245, the totality of the internal operations of the synthesizer were distinguished by changes of state in the generators. According to the present invention, all operations are now carried out from an interconnected read chain of data contained in the virtual keyboard, with the chain depending on changes of the generator state.

The virutal keyboard is now the essential component of the synthesizer, out of which all commands issue. It comprises an assembly of memories which may thus be addressed from within the synthesizer for synthesis operations, and from outside the synthesizer for synthesis commands (commands as to the fequency and amplitude of the signals to be produced).

The user accesses the virtual keyboard through a data processing system which is not part of the present application. Depression of a key or pedal of the instrument is detected by the data processing system, which determines the actions on several memories of the "virtual keyboard," in terms of a program registered in the data processing system. This enables obtainment of the production of complex signals which are the sum of several elementary periodic signals from the synthesizer. Specifically, if the periodic signals are sinusoidal, the synthesis achieved is an additive synthesis or a Fourier synthesis.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
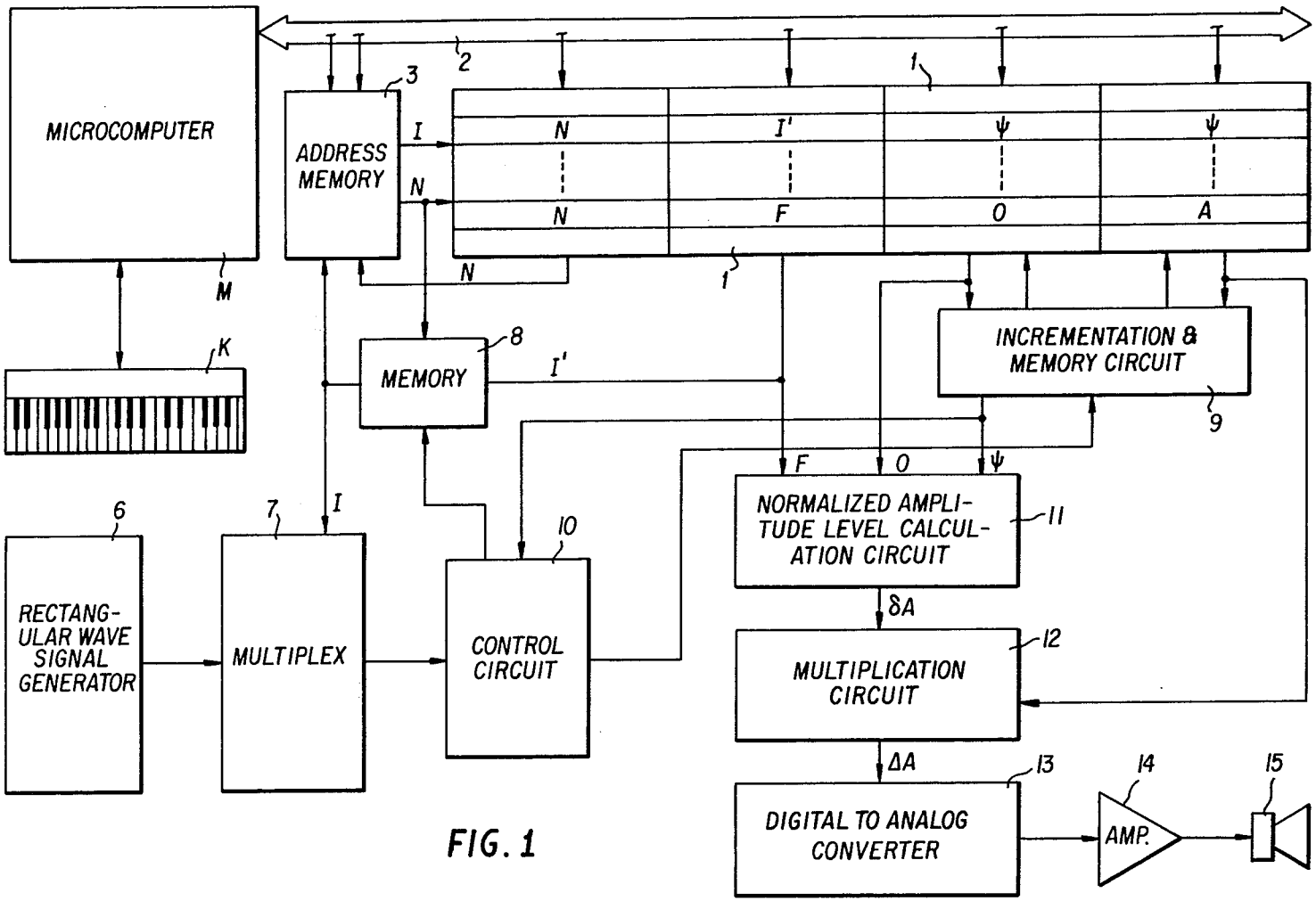
FIG. 1 is a diagram of a synthesizer according to a first embodiment of the present invention wherein the control memory is divided into groups.

Referring now to the drawings, wherein like reference numerals designate identical or corresponding parts throughout the several views, and more particularly to FIG. 1 thereof, which represents a conceptual diagram of the synthesizer according to the invention.

The synthesizer is coupled to an outside microcomputer system M through a set of connections called bus 2. The bus transmits address selection signals, data signals, and write (and possibly read) command signals, for external control of the synthesizer.

By way of example, the microcomputer system is connected to one or more organ keyboards K and, if necessary, to pedals, buttons, stops, or any other device for activating data or events or for presenting information, which are not shown.

Thus the microcomputer system places the data into the memories of the virtual keyboard 1, in terms of the events which it registers (depression or release of keys, buttons, stops, etc.), of a recorded program, and of descriptive data on the tones or tone timbres which are produced by the synthesizer.

Virtual keyboard 1 comprises a set of memories which are selected using an address memory 3. Access to these memories occurs from the microprocessor, on the one hand, and from the other circuits of synthesizer, on the other hand. Multiplex circuits (not shown in the figure), enable the dual accessing without conflict.

Virtual keyboard 1 is divided into groups. Internal addressing of a memory within a group occurs using two signals, one I, to designate the group, and the other N, to designate the memory within the group I.

The synthesizer further comprises a given number of rectangular signal generators together designated by reference 6. By rectangular signal is meant any binary signal, square wave signal, or pulse signal. There are, for example, 12 periodic signal generators the repeat frequencies of which are distributed according to the 12 half-tones of an octave, as well as four variable frequency generators, controlled either analogically by voltage or current, or digitally. One of these generators may also be a noise generator, i.e., a generator of uncertain frequency.

In virtual keyboard 1, the number of groups is equal to the number of generators.

The selection of the memories of a group by the read control means brings about simultaneously the selection of a generator signal, using multiplex circuit 7.

During execution of the operations relating to the data of a group, the selection address of the group is held in memory 8. The selection addres is applied, on the one hand, to multiplex circuit 7 for selection of a generator signal and, on the other hand, to address memory 3 for selection of the corresponding group. Incidentally, memories 8 and 3 may be joined.

The signal from the selected generator serves to increment an instantaneous phase datum common to the signals produced by the whole of the corresponding group. To do this, an incrementation and memory circuit 9 is coupled to multiplex circuit 7 through control circuit 10 and to virtual keyboard 1. Details of the structure and operation of these circuits will appear in the following.

Finally, the entirely of the data relative to the synthesis of an analogic stage for each outgoing periodic signal is applied to the digital-analog conversion means. The latter comprises a normalized amplitude level calculation circuit 11, a multiplication circuit 12, a digital-analog converter 13, an amplifier 14 and a loudspeaker 15, the latter two elements not being included in the synthesizer.

Calculation circuit 11 receives the instantaneous phase $\Psi$, incremented and memorized by circuit 9, the octave row number 0, and the wave form number, the latter members read from a memory of a virtual keyboard group, and delivers the value $\delta A$ of an amplitude level. Circuit 11 comprises, for example, a wave form pattern memory which automatically delivers the datum $\delta A$ read to an address formed by the aforementioned digital input signals.

Multiplication circuit 12 carries out the multiplication of value $\delta A$ by the amplitude value A read in the virtual keyboard memory and delivers digital value $\Delta A$.

Finally, converter 13 transforms said value $\Delta A$ into an analog level of current or voltage which is then amplified in 14 and diffused by loudspeaker 15.

The following description will cover the structure and operation of each element of the synthesizer in greater detail.

Figure 2:
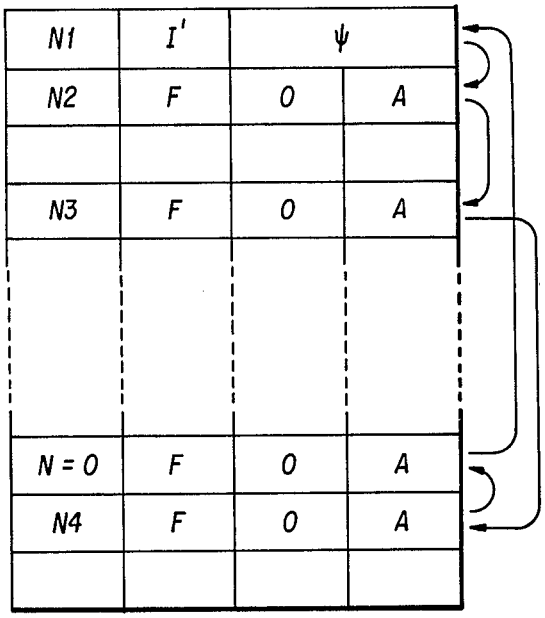
FIG. 2 illustrates the organization of data within a group of the control memory.

FIG. 2 describes the structure of the virtual keyboard. This structure is important. It comprises the operation of the entire synthesizer.

In the following description, numerical values are given solely by way of indication. The virtual keyboard is divided into 16 groups of memories, as many groups as there are generators 6. Each group is itself divided into 16 memory blocks of 16 bits each.

Each memory block is again divided into four words of four bits each. It is this latter division which appears in FIG. 1.

There are thus $16\times16=256$ blocks of four words, and each word contains at least one datum.

During operation of the synthesizer, the blocks are read one by one and the data that they contain are transferred and used by other circuits.

By its content, address memory 3 selects a virtual keyboard block from among the 256.

The selection address has two parts, one of four bits specifying the group number I, and another of four bits specifying the number N of a block within the group.

To simplify FIG. 2, only one group is represented.

The first block of the group is characterized by the value $N=0$.

The four words which it contains are related respectively from left to right to the number N1 of the next block to be read in the group (four bits), the number 1' of the group following when processing related to the present group is finished, and the two parts (upper and lower) of the instantaneous phase ' of the basic signal.

Reading of this block thus enables parallel obtainment of the three pieces of information N1, I' and $\psi$.

Let us suppose that address memory 3 is pointed to this first block and that the generator signal selected by multiplex circuit 7, by number I, has changed state. Circuit 9 then increases the value of $\psi$ by one unit and writes the new value of $\psi$ in the block (I, $N=0$) and retains in memory this value of $\psi$.

Next, the value N1 read in this block is transmitted to address memory 3, which addresses block (I, N1) of the same group.

The words of this block are then the following: Value N2 of the block in the same group serves to address the following block. Value F serves to specify the desired wave form. Value 0 serves to specify the harmonic or octave row of the output signal, with respect to the basic signal of which $\psi$ is the instantaneous phase. Finally, value A is the amplitude of the output periodic signal.

The data contained in each block are not limited to those described above. For example, an analog output signal path number might be specified, etc.

At the same time that these data are read and transmitted to conversion means 11, 12, 13, which calculate an analog level, value N2 serves to specify the new block to be read in the group.

Reading of this new block enables acquisition of new data F, 0, A and N3, and so on.

The last block read in group I yields data F, 0 and A as well as a last value N=0, which enables return to the first block where the address of the first following group (I', N=0) is extracted.

It should be noted that the chain for reading the blocks of a group is such that all the blocks of a group are not necessarily read. If a value N is never specified within this block, the corresponding block will be ignored. In the same way, reading of the block is sequential, but the order in which this reading is done is not necessarily the order of N values.

Figure 3:
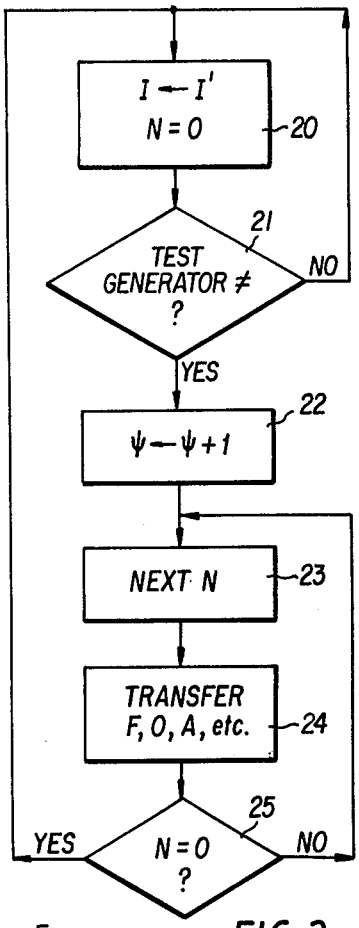
FIG. 3 is a flow chart illustrating the operation of the synthesizer according to the first embodiment of the present invention.

FIG. 3 shoes a flow-chart which describes the chain of synthesizer operations.

Suppose that the address memory specifies the first block of a group I (N=0).

At this moment, the synthesizer performs a test 21 to know whether generator number I (selected by multiplex circuit 7) has changed state. Complete processing of the data of a group is thus carried out only every half-period of the corresponding generator. To do this, control circuit 10 may consist simply of an exclusive OR circuit, the two inputs of which receive respectively the output of multiplex circuit 7 and the bit of lowest weight of the phase value $\psi$ read from the block (I, N=0). An active signal is delivered by the exclusive OR only if the two inputs are different. In this case, phase $\psi$ is increased one unit, written into block (I, N=0) in place of the preceeding value, and held in the memory in circuit 9, to be used at the same time as the data read from the other blocks of the same group.

If control circuit 10 does not deliver any active signal to circuit 9, it orders the transmission, by memory circuit 8, of the next value I' to address memory 3. Synthesis of the analog levels of the signals of the previously read block have therefore not been carried out. Testing of the following generator is then performed (operations 20 and 21, FIG. 3), and so on.

As soon as a generator test is positive, synthesis of the levels may take place, and it unfolds as indicated in FIG. 3.

After incrementation of phase $\psi$ (operation 23, carried out by circuit 9), the block specified by the following N value is read, entailing reading of values F, 0, A, etc., and synthesis of a corresponding level (operation 24). Then the value of the following N is compared to zero (operation 25). As long as the test is negative, successive readings of the blocks of group I take place. As soon as the test is positive, the transfer of the following value I (and N=0) enables recommencement of the same cycle for another group (return to operation 20).

Figure 4:
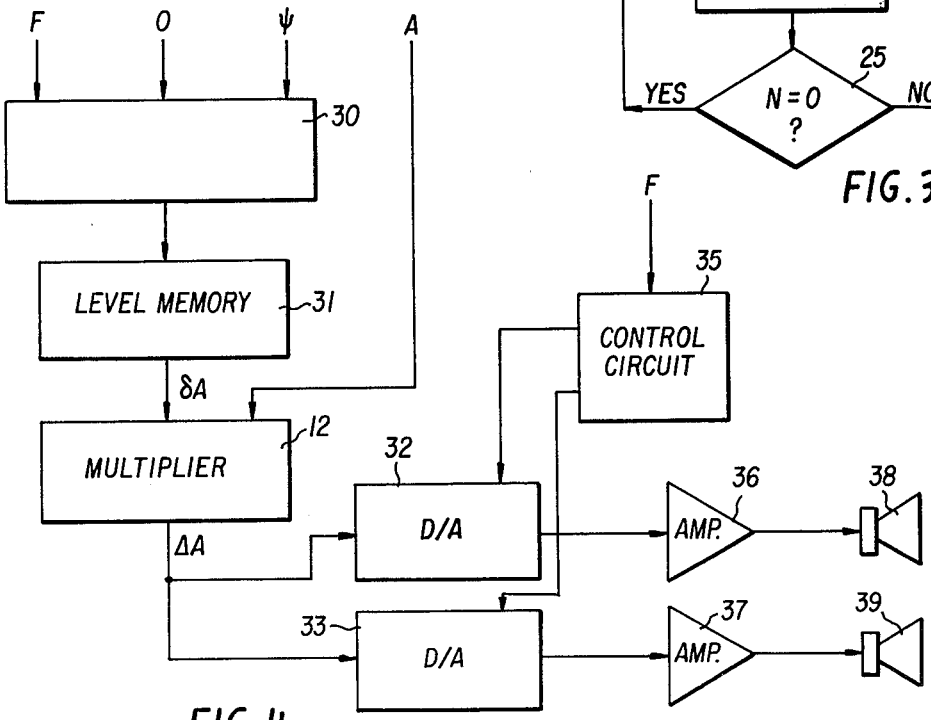
FIG. 4 illustrates an embodiment of a digital-analog converter according to the present invention.

FIG. 4 shows in detail the structure of the converter.

The values for phase $\psi$, harmonic or octave row 0, and wave form F are applied simultaneously to a circuit 30. The circuit 30 works up an address which is applied to a level memory 31. This memory contains successive patterns of one or more wave forms, in differential representation. The gap in amplitude $\delta A$ read is added to the preceeding amplitude to obtain the new amplitude of the analog signal.

A multiplier circuit 12 calculates the product of value $\delta A$ and real amplitude A read from the block of virtual keyboard 1. The result $\Delta A$ is next applied to two digital-analog converters 32 and 33, one or the other controlled by control circuit 35.

This embodiment enables delivery of different signals to several different analog outputs, with the number of outputs being given solely by way of example, of course.

Distinction of the analog outputs is likewise done using data contained in the virtual keyboard. For example, only three bits are used for the choice of one wave form from among eight, with the fourth bit being used for choice of the analog signal path.

In the case of FIG. 4, control circuit 35 is, for example, a flip-flop. One of the outputs of the flip-flop authorizes transmission of a datum to one digital to analog converter, while the other output forbids transmission to the other converter.

The structure of the digital to analog converters is known, having been described in the aforementioned French patent No. 7720245, particularly in FIG. 4. They each contain an addition-subtraction circuit, an up-down counter, and an integrating circuit. They are followed respectively by amplifiers 36 and 37 and loudspeakers 38 and 39. Analog filtration circuits having particular frequency responses may obviously be inserted in each analog signal path. Most often, incorporated into amplifiers 36 and 37, such filtration circuits, called "formats," can be used to improve the sound result of certain complex wave forms. This is the case, for example, for signals which imitate the traditional wind or string instruments. In this case, the synthesizer comprises a sufficient number of analog output signal paths to separate the complex signals from each other. This separation is particularly easy under the present invention since the indication of the output signal path of each analog pattern is included in the set of digital data which are at its origin (F, 0, A, etc.). In the case where the number of analog output signal paths is greater than two, circuit 35 is constituted, for example, by a decoding circuit.

Circuit 30, which determines the address of pattern $\delta A$ in memory 31, comprises classical logic circuits. Phase value $\psi$ is multiplied by value 0 for production of harmonics. In the case where the number 0 corresponds to octaves with regard to the basic, phase $\psi$ simply undergoes a number of shifts toward the left equal to the number 0.

Multiplier circuit 12 may likewise be constituted by a fixed memory. Digital input values $\delta A$ and A make up the address of a value in memory. This value is then the product $A \times \delta A$.

An improved converter structure enables easier obtainment of a high number of analog output signal paths. Under this improvement, the set of up-down counter circuits is replaced by a commercial digital-analog converter circuit, e.g., a current 8-bit model. This converter is then followed by a demultiplexing circuit which receives from elsewhere the signal path selection information read in the memory of the virtual keyboard. The path selection control circuit is no longer necessay, since this selection is performed directly within the demultiplexer, which generally includes a built-in decoding circuit. Each output signal path of the demultiplexer is next connected to the input of an integrator having the same characteristics as the converter integrator previously described. As previously indicated, each analog output signal path may, as complements, include filtration circuits adapted to one type of signal or timbre.

The improved converter functions in the following way: In the course of a group memory read cycle, the outset of the cycle is devoted to incrementation of the phase of the basic signal. At the input of the converter, therefore, there are no data to convert during the beginning of the cycle, and this lasts for several microseconds. Then, as reading of the data in the other memories of the group progresses, the converter receives successively the data read and yields as an output a set of analog patterns of well-defined, constant duration. These patterns are next distributed by the demultiplexer to the integrators, which then deliver a signal, the level of which (voltage or current) varies proportionally (in size and sign) with the amplitude of the patterns applied.

The essential advantage of this converter structure resides in the fact that the successive patterns delivered by the converter all issue from the same group, and that between each set of patterns there elapses an interval of time sufficiently long to do away with any possible instability in the circuits, due among other things to flaws of linearity in the conversion, non-negligeable set-up times, etc. The result is better immunity of the synthesizer to intermodulations of signals between groups, thanks to the structure of the virtual keyboard and to the progression of the read cycle on the data which it contains.

Figure 5:
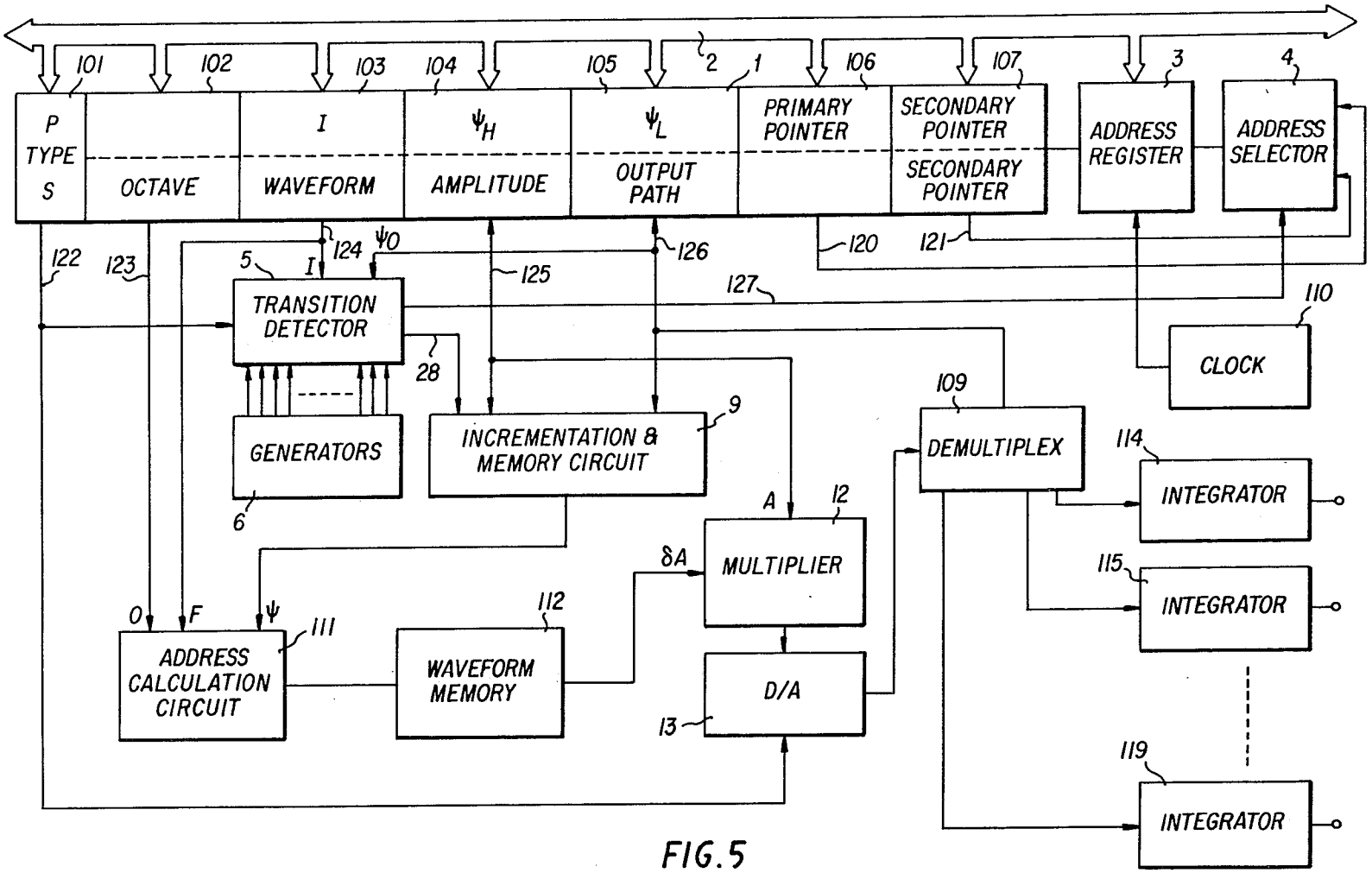
FIG. 5 is a diagram of a synthesizer according to a second preferred embodiment of the present invention.

FIG. 5 describes another preferred embodiment in which the separation of the virtual keyboard's memory into groups is no longer predetermined. In fact, in the preceeding embodiment, each group contains a fixed number of memory blocks, which limits the number of elementary tone components connected with each generator. According to this new embodiment, the size of the groups is no longer determined in advance but results from the chain connection process. Thus, since all of the groups are practically never used at the same time, a greater number of tone components can be created in the groups used for a given memory capacity of the virtual keyboard.

Each group of blocks contains a primary block and secondary blocks. Each primary block contains, at least, a block identification word, a word relating to generator number, a word relating to the common submultiple of the instantaneous phase of several periodic signals, and a word containing an address pointer towards another primary or secondary block. Each secondary block contains, at least, a block identification word, a word relating to the amplitude of a periodic signal, a word relating to the harmonic or octave row of said signal, and a word containing an address pointer towards another secondary or primary block.

The pointers are used by the sequential chain connection means in such a way that each block read contains a pointer towards a following block to be read: In this way, only those blocks containing useful data are addressed and read. These blocks may be located in any position whatever within the memories.

In addition, the chain created is in fact a double chain: a chain of primary blocks and a chain of secondary blocks.

Reading of primary blocks alone is carried out so long as the state of the associated generators (designated by their number in each block) does not change. With each change of state of a generator, the chain is interrupted at the corresponding primary block and the associated secondary blocks are then placed in the chain.

Virtual keyboard 1 is also coupled to a microcomputer bus 2 where the microcomputer can read and write digital data. Multiplexing means (not shown) enable access to the memories of the virtual keyboard by the bus or by the synthesizer.

The virtual keyboard is divided into 256 memory blocks, for example. Each block may be addressed separately, and the address of a block is defined by a set of eight bits. Address register 3 thus contains, for each operation, the address of a block, and the blocks are read one by one in succession.

Each block is divided into several words which are addressed in parallel. These words are designated by references 101, 102, 103, 104, 105, 106 and 107 for the two types of blocks (primary and secondary).

These words contain the data which serve in the synthesis of the sound component patterns (common submultiple of the instantaneous phase of several components, generator number, octave or harmonic number, type of wave form, amplitude of the component, output path number, etc.).

The length of each word is unimportant, depending only on the number of values which the size in question may take.

There are two types of blocks which differ only in the information which they contain. These are primary blocks and secondary blocks.

The primary blocks contain the generator number and instantaneous phase data, at least, as well as an identification bit of the primary type (1 for example).

The secondary blocks contain data on octave or harmonic number, type of wave form, amplitude, and output path number, at least, as well as an identification bit of the secondary type (bit 0, for example).

Each primary block is related to a generator, whereas each secondary block is related to a tone component of the output signal.

Each primary block further comprises two words which contain respectively a primary address pointer and a secondary address pointer.

Each primary pointer designates the address of another primary block, either directly (absolute address) or indirectly (relative address). To simplify the explanation, it will be supposed that each pointer contains an absolute address.

Each secondary pointer designates the address of another secondary or primary block.

Each secondary block contains as well a word containing a secondary address pointer designating the address of another secondary or primary block. From the point of view of bit placement, the secondary pointers of the two blocks coincide.

The primary and secondary pointers serve to determine the chain of reading of the blocks.

An address selector 4 receives the two primary and secondary pointers by connections 120 and 121 and transmits one of the two pointers to address register 3. A clock 110 periodically generates impulses which are applied to register 3. With each impulse, the address (the pointer selected) is registered in register 3 and the latter then orders the addressing of the block designated by that address.

The various pointers are placed within the memory blocks by the microcomputer in such a way that the chain of block addresses by register 3, under the rhythm of clock 110, satisfies the conditions described below.

Each impulse of clock 110 therefore entails the addressing of a new block and, by consequence, the performance of a new series of operations.

According to the type of block read, primary or secondary, the virtual keyboard delivers either a first series of data or a second series and brings about either a first series of operations or a second, respectively.

The synthesizer circuits which are connected to the virtual keyboard may thus receive two types of information, of which only one may be taken into account.

The block identification bits, before the same placement (101) in the two blocks, serve, on the one hand, to distinguish data from a primary block from data from a secondary block and, on the other hand, to approve or inhibit certain synthesizer operations.

The unfolding of the operations of the synthesizers is thus entirely conditioned by the chain reading of the primary and secondary blocks, the details of which are given in the following.

Primary Blocks

Generator number I (word 103) is applied by connection 124 to a transition detector 5 which receives all signals from generators 6.

Instantaneous phase submultiple $\psi$ (words 104 for heavy weights and 105 for light) is applied to the incrementation circuit and memory 9 by bidirectional connections 125 and 126. The state of the generator selected is compared to the light-weight phase bit $\psi_0$ applied to detector 5 to detect a change of generator state.

The block type identification bit (word 101) is likewise applied to detector 5 (connection 122) in order to authorize detection only if the block in question is primary.

Two cases may occur:

If there is no change of generator state, then by connection 127 applied to selector 4, detector 5 orders selection of the following primary block (selection of the primary pointer applied to register 3) and operations continue to exactly the same way for another primary block, entailing the test of another generator.

If there is a change of state in the generator designated in the block, detector 5 sets off, on the one hand, the incrementation and memorization of phase value $\psi$ by circuit 9, with the incremented value being immediately commited to memory in the primary block in the place of the preceeding value, and, on the other hand, the selection (by connection 127) of the secondary pointer (word 107). In the following period of clock 110 there then ensues the reading of a secondary block.

Secondary Blocks

Connection 127 transmits a secondary block selection command to selector 4.

Phase value $\psi$, commited to memory by incrementation circuit 9, is applied to an address calculation circuit 111. The octave number (word 102) is likewise applied to this circuit by link 123 and F, the wave form number (word 103), by link 124. The data are combined so as to address a wave form memory 112 from which is drawn a pattern which is applied to a multiplier circuit 12. This circuit receives at the same time amplitude value A (word 104) from connection 125. The result of the product is applied to a digital-analog converter 13. The secondary block identification bit (word 101) is applied to the converter in order to validate the conversion in this case alone. There is therefore no conversion in the case of the reading of a primary block. A demultiplexer 109, controlled by the output path number (word 105), receives the output analog signal from converter 13 and points this signal towards one of integrators 114, 115 . . . 119.

All these operations take place in less than one period of clock 110.

Upon the impulse of this clock, with the secondary pointer of the secondary block being selected, register 3 addresses a new block which may either be another secondary block or another primary block.

Figure 6:
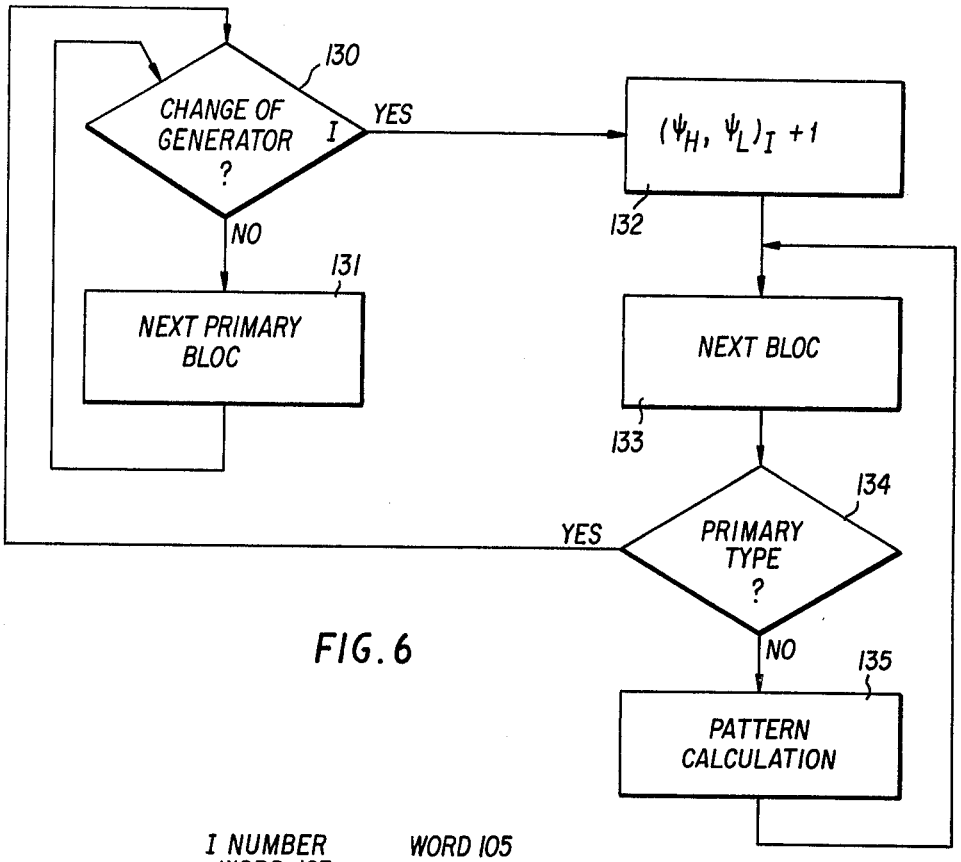
FIG. 6 is a flow chart illustrating the operation of the synthesizer according to the second embodiment of the present invention.

FIG. 6 shows a flow-chart explaining the reading and conversion control means according to the synthesizer chain of FIG. 5.

It will be supposed that a new primary block has just been addressed. Generator number I (word 103, FIG. 5) is applied to transition detector 5 to test the state of the corresponding generator (test 130, FIG. 6).

Two cases may occur:

Either the generator being tested has not changed. In this case, the detector sends forth a primary pointer selection signal (block 131, FIG. 6) and the generator tests continue (loop 130→131→130→131, etc.) until a change of generator state is detected;

Or the generator has changed state. In this case, the instantaneous phase value $\psi$ is first incremented (132), then the secondary pointer is selected (133) enabling address of a series of secondary blocks.

As soon as a new block is addressed, if the block is a secondary one, a pattern is calculated (135) and delivered to one of the analog outputs using the previously incremented phase value (test 134 negative).

If the block is primary, the chain continues for another generator (test 134 positive).

Thus, with each change of generator state, all secondary blocks relating to that generator are explored and the corresponding tonal elements calculated and delivered.

If there is no change of generator state, the corresponding secondary blocks are not even addressed.

In addition, if the generator number does not appear in the chain, its state will not even be tested.

The block reading chain under the present invention is therefore conceived so as to be covered as quickly as possible, without useless addresses or calculations.

Figure 7:
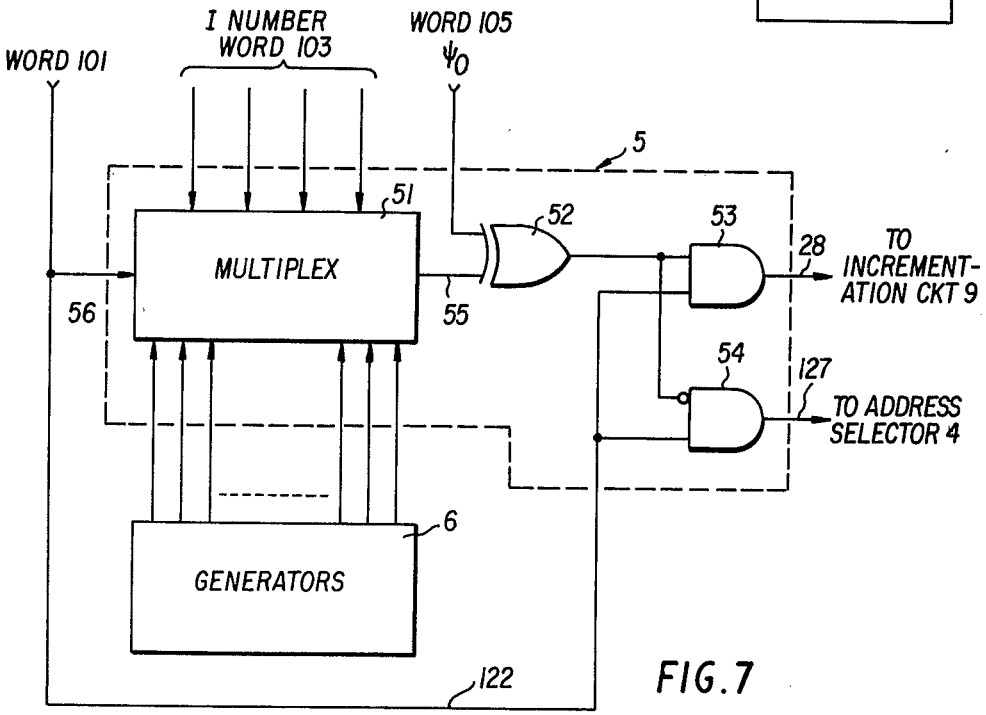
FIG. 7 is a detailed diagram of the generator transition detection logic of the present invention.

FIG. 7 shows transition detector circuit 5 in detail.

The circuit comprises essentially a multiplex circuit 51 which receives generator signals 6, on the one hand, and the I number (word 103), on the other, as a selection order. Generators 6 deliver square wave signals so that output 55 from the multiplex is a binary signal (bit stream).

The identification bit (word 101) is likewise applied to a validation input 56 so that only a primary block may select a generator.

An exclusive OR circuit 52 receives the multiplex output signal as well as the lightest weight bit $\psi_0$ of the instantaneous phase.

The output of circuit 52 is connected to a non-inverting input of an ET circuit 53 and to an inverting input of an ET circuit 54.

Block identification signal (101) is likewise applied to non-inverting inputs of ET circuits 53 and 54.

The output of ET 53 controls phase incrementation circuit 9. In practice, this circuit's output can only be active (in state 1 in this case) if the block selected is a primary one (signal 101 at 1) and if the designated generator has changed state (output at 1 of exclusive OR 52).

The output of ET 54 controls the selection of the primary and secondary pointers (selector 4).

In practice, if the block identification bit is at 0 (secondary block or if the change of state of a generator is detected, the output of ET 54 is in state 0, ordering the selection of a secondary block. Selection of a primary pointer is obtained only if the block read is of the primary type and if the corresponding generator has not changed state.

This second variant of the invention enables improvement in the speed of calculating the tonal elements of the synthesizer without limiting the number of tonal elements for each generator.

Due to the fact that following calculation of the tonal elements tied to a generator there elapses a period of time at least as long as a period of clock 110 (during the reading of at least one primary block) before calculation of another series of tonal elements, the possible intermodulation of the tonal elements of two consecutive series is practically eliminated.

The present invention is applicable to electronic musical instruments. Such a musical instrument would include a synthesizer according to the present invention controlled by a microprocessor device, for example, for loading data into the memories of virtual keyboard 1 in a desired chain. According to the richness of the tonal signals desired, generators 6 would contain between 12 fixed frequency generators and 16 or more variable frequency generators.

According to a simplified embodiment of the invention, the address or a part of the address of the memory blocks may be used as conversion means, in the same way as the contents of these blocks. This is possible, for example, for generator number 1 and/or the octave row. This embodiment diminishes the flexibility of use of the memories but reaches the number of memories necessary. Futher, a different arrangement of data within the memories is possible.

Obviously, numerous additional modifications and variations of the present invention are possible in light of the above teachings. It is therefore to be understood that within the scope of the appended claims, the invention may be practiced otherwise than as specifically described herein.

I claim:

1. A polyphonic synthesizer of periodic signals comprising:

sample production means having inputs for receiving at least a digital phase and a digital amplitude data from a source of digital phase and digital amplitude data and an output for producing a corresponding digital sample value of a predetermined waveform;

means for digital-to-analog conversion of each digital sample value produced by the sample production means;

a given number of generators for producing rectangular waveform signals of different frequencies, each periodic signal produced by said synthesizer being harmonically related to a rectangular waveform produced by one of said generators;

memory means, said memory means including a plurality of addressable groups of memory blocks, each group including a plurality of memory blocks, each group containing at least a digital data representing the instantaneous phase $\psi$ of a periodic signal to be produced, a digital data representing the amplitude A of said periodic signal, digital addressing data representing the address of another group, and a digital data I for selecting one of the generators; and controlling means for sequentially reading the memory groups in response to the addressing data of each group, for selecting a generator signal with the respective selecting data I read in each group, and for applying the phase and amplitude data to the sample production means in substantial synchronization with the selected generator signal;

whereby at least one periodic signal is produced, said at least one periodic signal being harmonically related to a rectangular waveform produced by one of said generators.

2. A polyphonic synthesizer as recited in claim 1, wherein:

said plurality of groups of memory blocks are located at predetermined addresses in said memory means, said controlling means addressing certain memory blocks within each group of memory blocks, a first addressed memory block within each group containing said digital data representing the instantaneous phase $\Psi$ of said periodic signal to be produced, an address of a second memory block to be addressed in each group, and a digital data I' representing the address of another group, said second memory block containing at least said digital data representing the amplitude A of said periodic signal, a digital data representing a waveform F of said periodic signal, and a digital data 0 representing an octave rank of said periodic signal.

3. A polyphonic synthesizer as recited in claim 2, wherein the digital to analog conversion means comprises:

an address calculation circuit receiving the instantaneous phase value and the octave rank read from the memory blocks;

a waveform memory providing an output, said waveform memory containing, at successive addresses, either a successive amplitude or an amplitude variation pattern for a waveform, with said memory connected to the address calculation circuit;

means for multiplication of each output of the waveform memory by the amplitude value read from the memory block;

a digital-analog converter to produce an analog pattern corresponding to each product of the multiplication means; and means for filtration of the analog signals produced by the digital to analog conversion means.

4. A polyphonic synthesizer as recited in claim 3, wherein the address calculation circuit further comprises:

a waveform selection input for receiving a waveform datum from a memory block.

5. A polyphonic synthesizer as recited in claim 3, wherein the digital to analog conversion means further comprises:

a demultiplexer circuit coupled to receive the output of the digital to analog converter and to receive a word relating to an analog output path number from said memory means as a control, said demultiplex circuit producing an output signal coupled to a plurality of filtration means.

6. A polyphonic synthesizer as recited in claim 3, wherein:

at least a portion of the address of each memory block includes at least one datum which is applied to the digital to analog conversion means.

7. A polyphonic synthesizer as recited in claim 2, wherein the set of memory blocks is divided into equal groups of the same number as the number of generators, with the address of each block of the same group including a common part (I); and wherein the control means includes means for selecting the generator corresponding to each group following the common part (I) of the address.

8. A polyphonic synthesizer as recited in claim 1, wherein:

said plurality of groups of memory blocks are located at nonpredetermined addresses in said memory means, each group including a primary block and a plurality of secondary blocks, said primary block being the first block addressed within each group by said controlling means, said primary block containing said digital data representing the instantaneous phase Ψ of said periodic signal to be produced, said digital data I for selecting one of said generators, a digital address pointer to a subsequent group, and an address pointer to one of said plurality of secondary blocks, each of said plurality of secondary blocks containing at least a digital address pointer to a subsequent secondary block, said digital data representing the amplitude A of said periodic signal, and a digital data 0 representing an octave rank of said periodic signal.

9. A polyphonic synthesizer as recited in claim 8, wherein each secondary block further comprises:

a memory containing a datum relative to a particular waveform for the periodic signal to be produced.

10. A polyphonic synthesizer as recited in claim 8, wherein the controlling means includes:

an address memory for addressing the groups and memory blocks, said address memory comprising a first input for receiving the number of the following block, read from the block addressed, and a second input to receive the number of the following groups; and a group selection memory comprising an input for receiving the number of the following group read from the primary block of the group addressed, an output connected to the second input of the address memory, and a control input for group address transfer when the block address is equal to the primary block address.

11. A polyphonic synthesizer as recited in claim 8, wherein each secondary block further comprises:

a memory containing an output path selection datum for the periodic signal to be produced.

12. A polyphonic synthesizer as recited in claim 8, wherein:

the memory means is divided into groups of memory blocks, independent in number from the generators, with the number of blocks in each group being variable, and each block containing, at least, a word designating a generator, a word relating to an instantaneous phase value, a word containing the primary address pointer designating another primary block, and a word containing a secondary address pointer designation, at least, a block identification word, a word relating to the amplitude of an output signal, a word relating to the octave rank of the output signal, and a word containing a secondary address pointer designating another primary or secondary block.

13. A polyphonic synthesizer as recited in claim 12, wherein the controlling means comprises:

a clock;

an address register delivering a block address simultaneously to the set of memories and having a memorization control input, connected to said clock, and an address input;

an address selector circuit, connected to the input of said register and comprising two inputs for receiving respectively the primary and secondary address pointers of each block, and a selection control input; and transition detector means connected to said generators and having an input for receiving the block indentification word, another input for receiving the word designating the generator, and outputs for delivering a selection signal to said address selector, and a phase incrementation order signal to said phase incrementation means.

14. A polyphonic synthesizer as recited in claim 13, wherein said transition detector means comprises:

a multiplex circuit receiving, as an input, the signals of said generators and, as a control input, the number (I) designating a generator read from a primary block and delivering as an output the instantaneous binary state of the signal of the generator selected;

an exclusive OR circuit receiving the output bit stream of the multiplex circuit and the lowest weight bit of the phase value read from the same primary block; and logic means receiving the exclusive OR output signal of said exclusive OR circuit and the block identification word for producing a phase incrementation order signal in the sole case where the block read is of the primary type and the change of generator state is detected, and for producing an address selection signal, either from the primary pointer in the case where the block read is of the primary type and no transition of the designated generator is detected, or from the secondary pointer in other cases.

15. A polyphonic synthesizer as recited in claim 8:

wherein the primary blocks of the memory groups each comprise a memory containing a datum I' for addressing a primary block of another group; and wherein the control means comprises means for addressing and reading an ensuing primary block in at least one of the cases (i) where the rectangular waveform signal of the generator corresponding to the preceeding primary block has not changed and the case (ii) where the sequential reading of the secondary blocks of the preceeding group has taken place, following a change in the rectangular waveform signal from the corresponding generator.

* * * * *